US006698754B2

(12) United States Patent
Gritzuhn et al.

(10) Patent No.: US 6,698,754 B2
(45) Date of Patent: Mar. 2, 2004

(54) DELIVERY TABLE

(75) Inventors: Dieter Rolf Gritzuhn, Kiel (DE); Uwe Hermann Goldbeck, Kiel (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/850,052

(22) Filed: May 7, 2001

(65) Prior Publication Data

US 2002/0011705 A1 Jan. 31, 2002

(30) Foreign Application Priority Data

May 15, 2000 (DE) ..... 100 23 796

(51) Int. Cl.[7] ..... B65H 5/12
(52) U.S. Cl. ..... 271/267; 271/264; 271/207
(58) Field of Search ..... 271/267, 207, 271/209, 264, 182

(56) References Cited

U.S. PATENT DOCUMENTS 5,366,217 A * 11/1994 Tokuno et al. ..... 271/176
5,975,521 A * 11/1999 Ono et al. ..... 271/188
6,206,367 B1 * 3/2001 Jo ..... 271/226
6,241,245 B1 * 6/2001 Hollar et al. ..... 271/264

FOREIGN PATENT DOCUMENTS

| | | |
|---|---|---|
| DE | 23 63 224 A | 12/1973 |
| DE | 30 36 385 A1 | 4/1981 |
| DE | 2 47 433 A1 | 7/1987 |

* cited by examiner

*Primary Examiner*—Eileen D. Lillis
*Assistant Examiner*—Michael Lowe
(74) *Attorney, Agent, or Firm*—Lawrence P. Kessler

(57) ABSTRACT

The invention relates to a delivery table (1) for flat material (2), in particular sheet paper, with a safeguard so that the material (2) does not slide on the delivery table (1). Exact and stable positioning of the flat material (2) is achieved in that the safeguard to prevent sliding of the flat material (2) is constructed as a surface (5) disposed in the back area (4) of the delivery table (1), exhibiting high friction vis-à-vis the flat material (2).

4 Claims, 2 Drawing Sheets

DELIVERY TABLE

FIELD OF THE INVENTION

The invention relates to a delivery table for flat material, in particular sheet paper, with a safeguard so that the material does not slide on the delivery table.

BACKGROUND OF THE INVENTION

A delivery table of this kind is disclosed in DD-247 433 A1 in which the latter is constructed as a sheet deliverer for a printing press and a stop serves as a safeguard, against which stop the sheets being conveyed strike and deliver themselves. Material to be delivered bounces back against such stops and the danger exist that during delivery it will not sit exactly at the stop. Moreover, the danger exists that, as result of vibrations, the material delivered, possibly even an entire stack of material, will move away from the stop because the material or stack exhibits too little friction vis-à-vis the delivery table.

The object of the invention is therefore to construct a delivery table of the kind stated at the outset such that exact and stable positioning of the flat material can be achieved.

The object is solved in accordance with the invention in that the safeguard to prevent sliding of the flat material is constructed as a surface disposed in the back area of the delivery table, viewed from the direction of conveyance, exhibiting high friction vis-à-vis the flat material.

SUMMARY OF THE INVENTION

The advantage of the invention consists in the exact positioning of the first sheet which is securely positioned by means of the high friction, whereby the position of additionally stacked sheets and, accordingly, the entire stack, is assured. The high friction surface additionally absorbs the movement of the first sheet and consequently prevents a slanting position from arising. Because the high friction surface is provided only at the end of the delivery table, the sheets of material to be delivered are otherwise able to freely slide and, therefore, surely reach their delivery position. By virtue of the construction in accordance with the invention, the provision of a stop can be dispensed with, which has the added advantage that the material to be delivered can no longer be damaged by striking against a stop.

One refinement of the invention provides that the delivery table is equipped with a conveyance and positioning device. The latter preferably acts together with the high friction surface in such a way that positioning takes place in a defined delivery position with the aid of the surface. This can be effected for example, in that, after reaching the delivery position, a flat material is pressed against the surface by means of at least one holding-down clamp.

The aforementioned delivery and positioning device can be refined in the most varying manner. One proposal provides that, disposed at the back area, the conveyance and positioning device exhibit horizontally and vertically movable tongues, actuatable and horizontally movable rollers and at least one horizontally and vertically movable holding-down clamp, with driving gears and control mechanism provided in such a way that a flat material lying between the rollers and tongues is conveyed by the rollers over the high friction surface into its defined delivery position, that the holding-down clamp then presses the flat material against the high friction surface, the rollers are lifted, the tongues withdrawn from the delivery table counter to the direction of conveyance and that to convey additional material, the holding-down clamp is lifted and withdrawn from the delivery area and that the tongues and rollers are again positioned over the back area. This or similar conveying and positioning units have the advantage that they convey the material to be delivered over the surface with high coefficient of friction, thereafter effecting immovable securing of the flat material by at least one holding-down clamp pressing the material against the surface with high coefficient of friction.

The high friction surface can extend over the entire width of the back area of the delivery table. It is expediently formed by a strip, which can be glued to the delivery table, in which case it has been shown to be advantageous if the strip exhibits a surface made of rubber.

In addition, guide strips connecting to the surface with increased friction and extending in the direction of conveyance can be disposed which exhibit lower friction vis-à-vis the flat material. This ensures that the flat material slides surely and without alignment error into the delivery position and can be positioned there in the above-described manner.

BRIEF DESCRIPTION OF THE DRAWINGS

The invention is elucidated in the following on the basis of the drawing. Shown are, in.

DETAILED DESCRIPTION OF THE INVENTION

Figure 1:
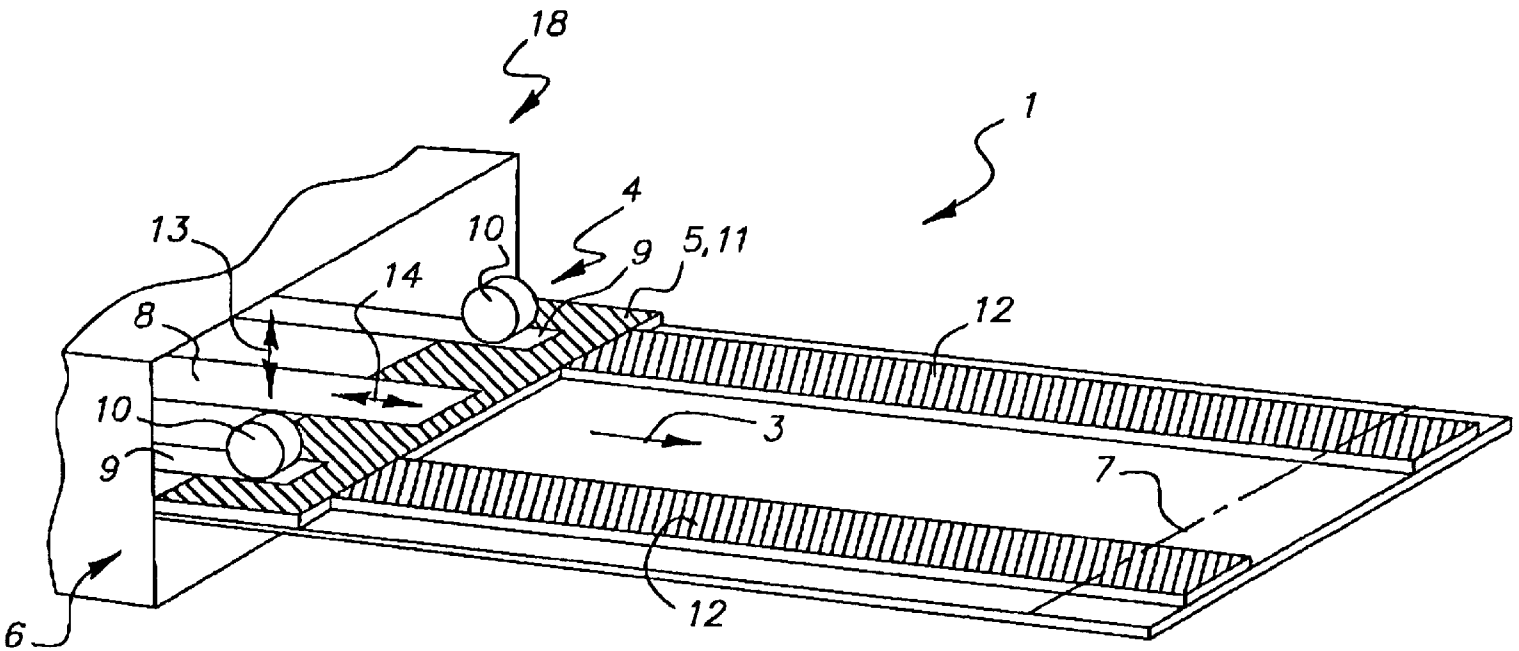
FIG. 1 an exemplified embodiment of the invention in perspective view.

FIG. 1 shows a delivery table 1 for flat material 2, which, for example, issues from a machine. It can, for example, be a printing press 18. Here, the flat material 2 must be conveyed to a delivery position 7, in which case the broken line of delivery position 7 shows the target position of the front edge of a material 2. To achieve this, provision is made for disposing a surface 5 in the back area 4 of the delivery table 1, viewed from the direction of conveyance 3, which exhibits high friction vis-à-vis the flat material 2. As a result, a material 2 coming onto the delivery table 1 in the direction of conveyance 3 and which then deposits itself thereon, strikes the surface 5 with its back portion and is securely positioned there by the high friction. At the same time, it can be provided that this positioning during delivery of the material 2 takes place exclusively by means of the surface 5 or that a conveyance and positioning device 6 is provided which carries out this positioning in a defined manner and, moreover, ensures that the material 2 is pressed onto the surface 5.

Figure 2:
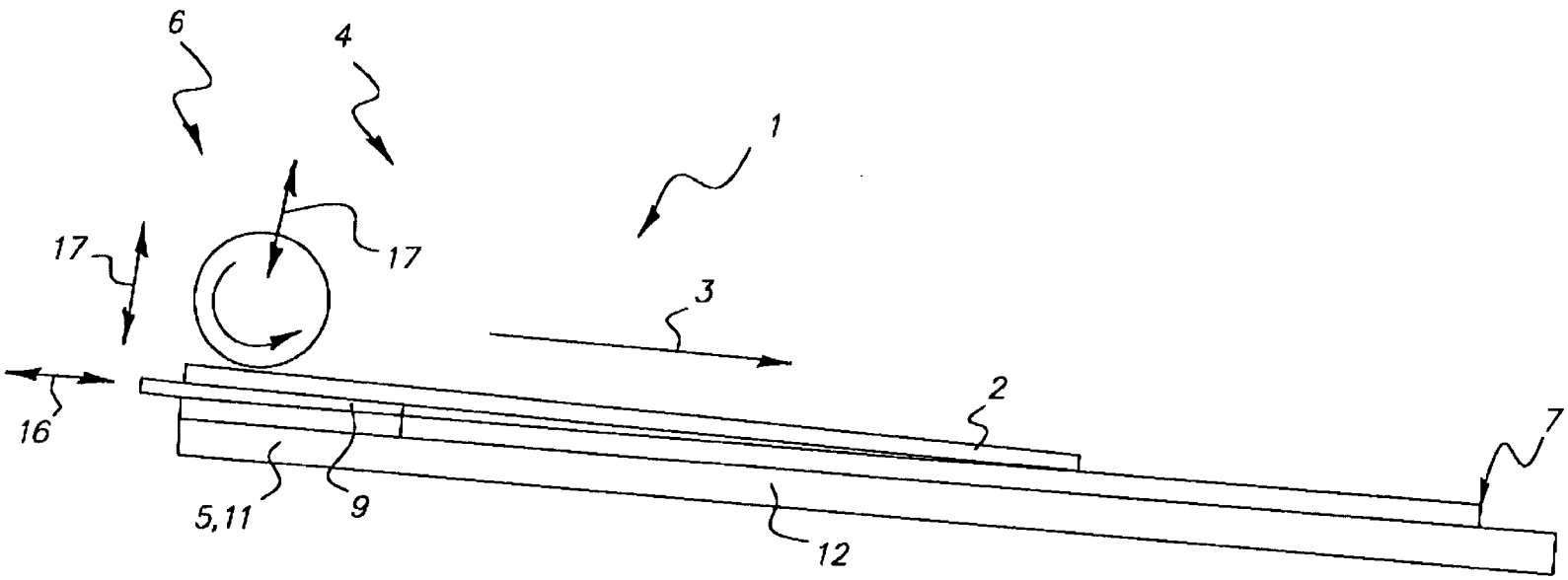
FIG. 2 in lateral view.

A refinement of one such conveyance and positioning device 6 is illustrated in FIGS. 1 and 2, where rollers 10 serve to convey the flat material 2. The rollers 10 are expediently combined with tongues 9, in which case the rollers 10, with their high friction surface vis-à-vis the flat material 2, convey the flat material 2 through rotation until the defined delivery position 7 is attained and then brake at the correct moment. The rollers 10 expediently act together with the tongues 9, which exhibit low friction and are disposed such that the flat material 2 slides on the tongues 9 and is conveyed by the rollers 10.

When a flat material 2 reaches the defined delivery position 7, a holding-down clamp 14 is actuated in such manner that it holds the flat material 2 in the defined delivery position 7 by pressing it onto the surface 5, which exhibits a high coefficient of friction. This surface is preferably a glued-on strip 11 with a surface 5 made of rubber. The rollers 10 subsequently lift through a vertical movement 17 and the tongues 9 are retracted in the direction of the double arrow 16 counter to the direction of conveyance 3, whereby the back end of the flat material 2, even in the areas in which the tongues 9 were, deposits itself, obtaining a secure position on the surface 5.

This process takes place during the delivery of all sheets of the flat material 2. The illustrated specific embodiment of a conveyance and positioning device 6 is, however, advantageous above all for the first sheet of flat material 2 because this method ensures that the flat material 2 slides surely over the surface 5 with increased friction, reaches the delivery position 7 by means of glide strips 12 with low friction and then, assisted by at least one holding-down clamp 8, is securely positioned by means of the surface 5 with increased friction.

For delivery of the next flat material 2, the tongues 9, through a horizontal movement 16 and a vertical movement 17, are repositioned into the position shown, above the previously delivered sheet, and rollers, 10 drop in such a way that a flat material 2 can again be conveyed between the tongues 9 and the rollers 10 up to the defined delivery position 7. The horizontal movement 14 of the holding-down clamp 8 functions as retraction means so that a new sheet can be delivered.

The description is only illustrative; it is, obviously, possible to combine the surface 5 with increased friction in accordance with the invention with a different kind of conveyance and positioning device 6 or to provide it such that the material 2 conveyed by the upstream machine deposits itself thereon without further assistance. The disposition of the delivery table 1 by a printing press 18 is also merely illustrative. On the contrary, the delivery table 1 can have any refinements, which ultimately accomplish the purpose that a flat material 2 can be immovably positioned in a defined delivery position 7.

PARTS LIST

1 delivery table
2 flat material
3 arrow: direction of conveyance
4 back area of delivery table
5 high friction surface
6 conveyance and positioning device
7 delivery position (of the front edge of the material)
8 holding-down clamp
9 tongues
10 rollers
11 glue-on strip
12 glide strip(s)
13 double arrow: vertical movement of the holding-down clamp
14 double arrow: horizontal movement of the holding-down clamp
15 double arrow: vertical movement of the tongues
16 double arrow: horizontal movement of the tongues
17 double arrow: vertical movement of the rollers
18 printing press

What is claimed is:

1. Delivery table (1) for flat material (2), in particular sheet paper, with a safeguard so that the material (2) does not slide on the delivery table (1), characterized in that the safeguard preventing sliding of the flat material (2) is constructed as a high friction surface (5) disposed in the back area (4) of the delivery table (1), viewed from the direction of conveyance (3), exhibiting high friction vis-à-vis the flat material (2); and having a conveyance and positioning device (6), disposed in the back area (4), with horizontally and vertically movable tongues (9), actuatable and horizontally movable rollers (10), at least one horizontally and vertically movable holding-down clamp (8), with driving gears and control mechanism provided in such a way that the flat material (2) lying between the rollers (10) and the tongues (9) is conveyed from the rollers (10) over the high friction surface (5) into a defined delivery position (7), that the holding-down clamp (8) then presses the flat material (2) against the high friction surface (5), that the rollers (10) are lifted, the tongues (9) withdrawn from the delivery table (1) counter to the direction of conveyance (3) and that to convey additional flat material, the holding-down clamp (8) is lifted and withdrawn from the delivery area and that the tongues (9) and the rollers (10) are again positioned over the back area (4).

2. Delivery table according to claim 1, characterized in that the high friction surface (5) extends over the entire width of the back area (4) of the delivery table (1).

3. Delivery table according to claim 1, characterized in that the high friction surface (5) is formed by a strip (11) glued onto the delivery table (1).

4. Delivery table according to claim 3, characterized in that the strip (11) has a surface (5) made of rubber.

* * * * *